US005595964A

United States Patent [19]

Bardasz

[11] Patent Number: 5,595,964

[45] Date of Patent: Jan. 21, 1997

[54] ASHLESS, LOW PHOSPHORUS LUBRICANT

[75] Inventor: Ewa A. Bardasz, Mentor, Ohio

[73] Assignee: The Lubrizol Corporation, Wickliffe, Ohio

[21] Appl. No.: 522,804

[22] Filed: Sep. 1, 1995

Related U.S. Application Data

[63] Continuation of Ser. No. 217,406, Mar. 24, 1994, abandoned.

[51] Int. Cl.[6] ..... C10M 137/08

[52] U.S. Cl. ..... 508/423; 508/425; 508/435; 508/436; 508/438; 508/563; 508/584; 508/199

[58] Field of Search ..... 252/32.5; 508/423, 508/425, 435, 436

[56] References Cited

U.S. PATENT DOCUMENTS

| | | | |
|---|---|---|---|
| Re. 32,246 | 9/1986 | Horodysky | 252/49.6 |
| 3,816,544 | 6/1974 | Brindell et al. | 260/619 |
| 3,979,308 | 9/1976 | Mead et al. | 252/32.5 |
| 4,111,821 | 9/1978 | Lazarus et al. | 252/49.9 |
| 4,582,617 | 4/1986 | Doner et al. | 252/32.7 |
| 4,584,115 | 4/1986 | Davis | 252/49.6 |
| 4,629,576 | 12/1986 | Small, Jr. | 252/32.7 |
| 4,689,162 | 8/1987 | Wirth et al. | 252/32.7 |
| 4,692,257 | 8/1987 | Horodysky | 252/49.6 |
| 4,925,983 | 5/1990 | Steckel | 252/50 |
| 4,927,553 | 5/1990 | Wright et al. | 252/49.6 |
| 5,062,975 | 11/1991 | Bayles, Jr. et al. | 252/33 |
| 5,102,567 | 4/1992 | Wolf | 252/46.6 |
| 5,342,531 | 8/1994 | Walters et al. | 252/32.5 |

FOREIGN PATENT DOCUMENTS

| | | |
|---|---|---|
| 046017 | 12/1991 | European Pat. Off. . |
| 4011694 | 1/1992 | Japan . |
| 2152073 | 7/1985 | United Kingdom . |

OTHER PUBLICATIONS

Smalheer, C. V., et al, "Lubricant Additives", pp. 1–11, 1967.

*Primary Examiner*—Ellen M. McAvoy
*Attorney, Agent, or Firm*—David M. Shold; Frederick D. Hunter

[57] ABSTRACT

A composition of an oil of lubricating viscosity, an antioxidant, an anti-nitration agent, and optionally a borated product of an epoxide or the reactive equivalent of an epoxide, provides a desirable lubricant for diesel or natural gas-fueled engines. The composition is substantially free from metals and preferably substantially free from phosphorus. The amount of the antioxidant the anti-initration agent are sufficient to reduce the amount of varnish formation in a natural gas engine.

12 Claims, No Drawings

ASHLESS, LOW PHOSPHORUS LUBRICANT

This is a continuation of application Ser. No. 08/217,406 filed on Mar. 24, 1994, now abandoned.

BACKGROUND OF THE INVENTION

The present invention relates to a lubricant for engines, in particular diesel and natural gas powered internal combustion engines.

Lubricant compositions such as crankcase motor oils have been the subject of much research to improve their physical and chemical properties. For instance, research has been directed to providing so-called ashless lubricants, that is, those which do not contain metals which form sulfated ash under the ASTM test D-784. Ashless lubricants would have the advantage of reducing combustion chamber deposits. But to prepare such a material which passes rigid performance tests has been difficult, since metal salts in the form of detergents have long been key components in engine oils. It is also desirable to minimize the amount of phosphorus in lubricants. Although phosphorus does not contribute to sulfated ash, it can lead to poisoning of catalysts in pollution control devices such as emission catalysts or traps when amounts of phosphorus make their way into the exhaust system. Nevertheless, many conventional antiwear additives contain phosphorus, so its total removal has presented a challenge. The present invention, however, provides an ashless, zero phosphorus or low phosphorus lubricant composition which is suitable for lubricating diesel and natural gas powered engines.

Doner et al. U.S. Pat. No. 4,582,617, Apr. 15, 1986, discloses grease compositions including a boronated epoxide (d), metal or non-metal phosphates, and a metal (or amine) hydroxy-containing soap grease thickener. Antioxidants are also disclosed.

Small, Jr. U.S. Pat. No. 4,629,576, Dec. 16, 1986, discloses engine lubricating oil containing (a) alkyl succinimide, and (d) a borated long chain 1,2 alkane diols. Other additives may be present to obtain a proper balance of properties such as dispersion and oxidation. Preferably the lubricant composition also contains neutral or over-based salts.

Horodysky U.S. Pat. No. Re. 32,246, Sep. 9, 1986, discloses lubricants containing borated epoxides. Other materials can be present including coantioxidants. Metal salts can also be present.

Wirth et al. U.S. Pat. No. 4,689,162, Aug. 25, 1987, discloses boron-containing compounds as additives for lubricants. Dispersants and antioxidants can also be present.

SUMMARY OF THE INVENTION

The present invention provides a composition comprising an oil of lubricating viscosity; an antioxidant; an anti-nitration agent, and preferably at least about 0.1% by weight of a borated product of an epoxide or the reactive equivalent of an epoxide; wherein the composition is substantially free from metals, and wherein the amount of the antioxidant and the amount of the anti-nitration agent are sufficient to reduce the amount of varnish formation in a natural gas-fueled internal-combustion engine. The invention further provides a process for lubricating an internal combustion engine, comprising supplying the above composition to the engine and operating the engine.

DETAILED DESCRIPTION OF THE INVENTION

The first component of the composition of the present invention is an oil of lubricating viscosity, including natural or synthetic lubricating oils and mixtures thereof. Natural oils include animal oils, vegetable oils, mineral lubricating oils of paraffinic, naphthenic, or mixed types, solvent or acid treated mineral oils, and oils derived from coal or shale. Synthetic lubricating oils include hydrocarbon oils, halo-substituted hydrocarbon oils, alkylene oxide polymers (including those made by polymerization of ethylene oxide or propylene oxide), esters of dicarboxylic acids and a variety of alcohols including some polyols, esters of monocarboxylic acids and polyols, esters of phosphorus-containing acids, polymeric tetrahydrofurans, and silicon-based oils (including siloxane oils and silicate oils). Included are unrefined, refined, and rerefined oils. Specific examples of the oils of lubricating viscosity are described in U.S. Pat. No. 4,326,972. The preferred oil is mineral oil.

The lubricating oil in the invention will normally comprise the major amount of the composition. Thus it will normally be at least 50% by weight of the composition, preferably 75 to 98%, and most preferably 85 to 96%. As an alternative embodiment, however, the present invention can provide an additive concentrate in which the oil is present in a concentrate-forming amount, e.g. less than 50% by weight, preferably 5 to 20%, and the amounts of the other components, described in greater detail below, are proportionately increased.

The second component of the present invention is at least one antioxidant. Oxidants comprise a wide class of well-known materials, notably including hindered phenols and aromatic amines. It is preferred that the antioxidant of the present compositions is at least one hindered phenol or at least one aromatic amine, or a mixture thereof.

Hindered phenols are generally alkyl phenols of the formula

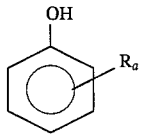

wherein each R is independently an alkyl group containing from 1 up to about 24 carbon atoms and a is an integer of from 1 up to 5. Preferably R contains from 4 to 18 carbon atoms and most preferably from 4 to 12 carbon atoms. R may be either straight chained or branched chained; branched chained is preferred. The preferred value for a is an integer of from 1 to 4 and most preferred is from 1 to 3. An especially preferred value for a is 2.

The hindered phenolic antioxidant is preferably an alkyl phenol, however, mixtures of alkyl phenols may be employed. Preferably the phenol is a butyl substituted phenol containing 2 or 3 t-butyl groups. When a is 2, the t-butyl groups normally occupy the 2,6-position, that is, the phenol is sterically hindered:

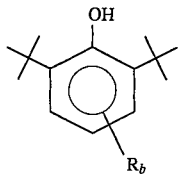

where b is 0 to 3. When a is 3, the t-butyl groups normally occupy the 2,4,6-position. Other substituents are permitted on the aromatic ring. In one embodiment the hindered phenolic antioxidant is a bridged compound in which two or more aromatic rings are linked by a bridging group; each aromatic ring bears a phenolic OH group. Examples of phenolic antioxidants include 2,6-di-t-butyl-p-cresol (i.e., 2,6-di-t-butyl-4-methylphenol, which is preferred), and 4,4'-methylenebis(2,6-di-t-butylphenol). These and other hindered phenolic antioxidants and their methods of preparation are well known to those skilled in the art. Such antioxidants are commercially available; one example of such a material is Catalin™ Antioxidant CA01, available from Ashland Chemical.

Aromatic amine antioxidants include aromatic amines of the formula

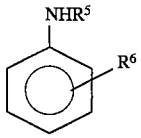

wherein $R^5$ is

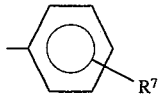

and $R^6$ and $R^7$ are independently a hydrogen or an alkyl group containing from 1 up to 24 carbon atoms. Preferably $R^6$ and $R^7$ are alkyl groups containing from 4 up to about 20 carbon atoms. A particularly useful amine antioxidant is an alkylated diphenylamine such as nonylated diphenylamine of the formula

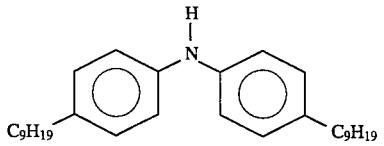

Aromatic amine antioxidants and their preparation are well known to those skilled in the art. These materials are commercially available and are supplied as Naugard⁻ 4386 by Uniroyal Chemical.

Other types of antioxidants include alkylated hydroquinones, hydroxylated thiodiphenyl ethers, alkylidene bisphenols, benzyl compounds, acylaminophenols, esters or amides of β-(3,5-di(branched alkyl)-4-hydroxyphenyl)propionic acids, aliphatic or aromatic phosphites, esters of thiodipropionic acid or thiodiacetic acid, and salts of dithiocarbamic or dithiophosphoric acids.

The antioxidant component used in the present invention is preferably a mixture of one or more hindered phenol antioxidants and one or more aromatic amine antioxidants, and most preferably a mixture of di-t-butyl-4-methylphenol and alkylated diphenylamine. The relative amounts of the phenolic antioxidant and the amine antioxidant are preferably 90:10 to 10:90 by weight, respectively, preferably 80:20 to 50:50 by weight.

The total amount of antioxidant used in the present compositions is significantly higher than the amounts customarily employed in ash-containing engine lubricants. Typically the amount of antioxidant in the final formulation will be at least 1.8% by weight, and preferably at least 2% by weight. The upper limit on the amount of antioxidant is not particularly limited, but practically will normally not exceed 10% by weight, more typically 5%. Of course, in a concentrate the amount of antioxidant will be proportionately increased.

Another component of the present composition is an anti-nitration agent. Anti-nitration agents are a diverse group of materials, somewhat akin to antioxidants, which serve to minimize the formation of nitrogen-containing organic compounds in the environment of an internal combustion engine. Anti-nitration agents can be considered to include certain phenolic antioxidants and metal passivators, but a preferred type of anti-nitration agent is a hydrocarbylamine phosphate salt, preferably an alkylamine phosphate salt, particularly where the phosphate is an ester. Thus the material is preferably an alkylamine salt of mixed mono- and di-esters of phosphoric acid. Such a material can be designated by the general formula $$R_2PO_4^{-}\ {}^{+NHR'}{}_2$$

where each R is independently hydrogen or a hydrocarbyl or substituted hydrocarbyl group, provided that no more than one R is hydrogen, and where each R' is independently hydrogen or a hydrocarbyl group, preferably an alkyl group, provided that at least one R' is hydrocarbyl. The R' hydrocarbyl group is preferably a branched alkyl group of 12 to 14 carbon atoms, and the amine salt functionality is derived from an amine available commercially and known as Primene™ 81R. In a preferred embodiment, one or both of the R groups is substituted hydrocarbyl, preferably a hydrocarbyl group containing dithiophosphate functionality. Such substituted hydrocarbyl groups can be expressed by the general formula $$(R^2O)_2-\overset{\overset{\displaystyle S}{\|}}{P}-S-R^3-$$

where $R^2$ is an alkyl group and $R^3$ is an alkylene group. In a preferred embodiment $R^2$ is hexyl and $R^3$ is propylene, the structure of the R group then being $$(C_6H_{13}O)_2-\overset{\overset{\displaystyle S}{\|}}{P}-S-CH_2-\overset{\overset{\displaystyle CH_3}{|}}{CH}-$$

These substituted hydrocarbyl groups can be derived from the corresponding substituted hydrocarbyl alcohol, the preparation and properties of which are described in greater detail in U.S. Pat. No. 3,197,405. The substituted hydrocarbyl alcohols can be reacted with phosphoric anhydride to form the phosphate esters, which in turn can be neutralized with the above described amines.

The amount of the anti-nitration agent should be sufficient to, in combination with the antioxidant, reduce the amount of varnish formation in a natural gas-fueled internal-combustion engine, compared to the amount formed in the absence of the anti-nitration agent. The actual amount will be expected to vary with the identity of the specific agent, but preferably the amount of anti-nitration agent will be 0.01 to 0.1 percent by weight of the final composition, and preferably 0.015 to 0.05 weight percent. The amounts, of course, will be proportionally increased in a concentrate.

A preferred component of the present invention is a borated product of an epoxide or the reactive equivalent of an epoxide, which is believed to serve as an antiwear agent. If this material is present, the antioxidant and antinitration components can be present in relatively lower concentrations than would otherwise be effective. The preferred epoxides are hydrocarbyl epoxides, which may be expressed by the general formula

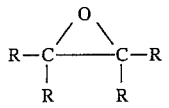

wherein each R is independently hydrogen or a hydrocarbyl group containing about 8 to about 30 carbon atoms, at least one of which is hydrocarbyl. Preferably one R is a hydrocarbyl group of about 10 to about 18 carbon atoms and the remaining R groups are hydrogen. More preferably the hydrocarbyl group is an alkyl group. The term "alkyl group" includes aliphatic hydrocarbon radicals (e.g. hexyl, heptyl, octyl, decyl, dodecyl, tetradecyl, stearyl, hexenyl, oleyl), preferably free from acetylenic unsaturation; substituted aliphatic hydrocarbon groups including substituents such as hydroxy, nitro, carbalkoxy, alkoxy, and alkylthio, and hetero atom-containing radicals. Also included are materials in which any two of the R groups together with the atoms to which they are attached, for a cyclic group, which can be alicyclic or heterocyclic. Examples of such materials are n-butylcyclopentene oxide, n-hexylcyclohexene oxide, methylenecyclooctene oxide, and 2-methylene-3-n-hexyltetrahydrofuran oxide. Mixtures of such materials can also be used. In a preferred embodiment, one R group is tetradecyl and the others are hydrogen.

Alternatively this material can be a reactive equivalent of an epoxide. By the term "reactive equivalent of an epoxide" is meant a material which can react with a boronating agent (described below) in the same or a similar manner as can an epoxide to give the same or similar products. An example of a reactive equivalent of an epoxide is a diol, in particular, a diol of the formula

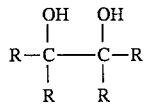

where the R groups are defined as above, for the epoxide. Other reactive equivalents include materials having vicinal dihydroxy groups which are reacted with certain blocking reagents. Another example of a reactive equivalent to epoxides is the halohydrins. Other equivalents will be apparent to those skilled in the art.

The epoxide or reactive equivalent thereof is reacted with a boronating agent to provide a borated product. Boronating agents include the various forms of boric acid (including metaboric acid, $HBO_2$, orthoboric acid, $H_3BO_3$, and tetraboric acid, $H_2B_4O_7$), boric oxide, boron trioxide, and alkyl borates of the formula $(RO)_xB(OH)_y$ wherein X is 1 to 3 and y is 0 to 2, the sum of x and y being 3, and where R is an alkyl group containing 1 to 6 carbon atoms.

The molar ratio of the boronating agent to the epoxide or reactive equivalent thereof is generally 4:1 to 1:4. Ratios of 1:1 to 1:3 are preferred, with 1:2 being an especially preferred ratio.

A preferred borated epoxide is obtained as the result of reacting boric acid with a 1,2-epoxide mixture, with the epoxide containing about 16 carbon atoms. Such a material can be prepared by reacting 1,2-epoxyhexadecane with boric acid. The mixture is heated to 80°–250° C. (preferably about 180° C.). The reaction can be carried out in the presence of water and toluene and/or a diluent oil.

The exact molecular structure of the boronated products is not known with certainty. It appears that the composition may comprise principally borated condensation products of the epoxide, having a postulated structure

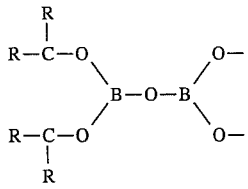

with minor amounts of compounds of one or both of the formulas

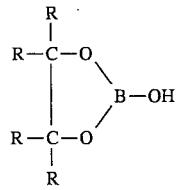

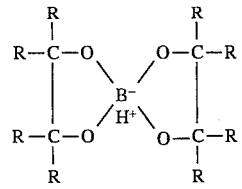

Such borated materials and their preparation are described in greater detail in U.S. Pat. No. 4,584,115. This document further describes a preferred synthetic route which minimizes foaming and exothermic reactions. This route involves inclusion in the reaction medium of a minor amount of a heel from a previous reaction of the boronating agent and epoxide.

The amount of the borated product, if present, is preferably at least 0.1% by weight, e.g., 0.2 to 4%, and more preferably 0.3 to 1% of the final composition. In a concentrate the amounts will be proportionally higher.

Another optional, but preferred, component of the present composition is a dispersant. Dispersants are well known in the field of lubricants and include monomeric and polymeric dispersants. Typical dispersants include N-substituted long chain alkenyl succinimides, having a variety of chemical structures including typically

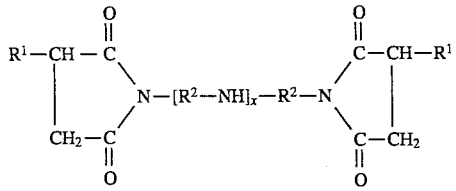

where each $R^1$ is independently an alkyl group, frequently a polyisobutyl group with a molecular weight of 500–5000, and $R^2$ are alkenyl groups, commonly ethylenyl ($C_2H_4$)

groups, and x is a small integer. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. No. 4,234,435.

Another type of dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another type of dispersant is Mannich bases. These are materials which are formed by the condensation of a higher molecular weight, alkyl substituted phenol, an alkylene polyamine, and an aldehyde such as formaldehyde. Such materials may have the general structure

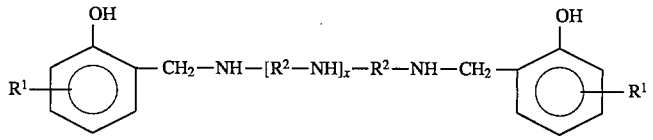

(including a variety of isomers and the like) and are described in more detail in U.S. Pat. No. 3,634,515.

Polymeric dispersant additives are generally hydrocarbon-based polymers which contain polar functionality to impart dispersancy characteristics to the polymer. These materials can sometimes also serve as viscosity index improvers, in which case one portion of the structure is similar to that of viscosity index improvers, and another portion contains "polar" compounds to impart the dispersancy characteristics. The general formula of such a polymer might be:

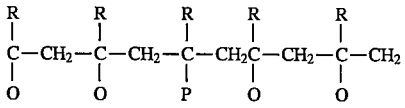

where O is an oleophilic group, P is a polar group, and R is hydrogen or an alkyl group. Among the many possibilities for the polar group are —C(O)—$NH_2$, —C(O)—NHR, —C(O)—O—R—$NR_2$, —C(O)—N(—ROH)—R—NH—R—OH,

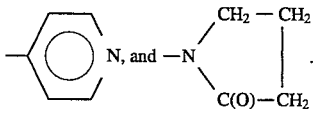

Such materials include copolymers of methacrylates or acrylates containing polar groups such as amines, amides, imines, imides, hydroxyl, or ether; ethylene-propylene copolymers containing such polar groups; and vinyl-acetate-fumaric acid ester copolymers.

In the present application it is preferred that the dispersant be a succinimide dispersant. The amount of the dispersant is preferably 1 to 10% by weight of the final composition, more preferably 2 to 5%, and proportionally higher if a concentrate is used.

Other materials which are conventional for use in lubricants may also be included in compositions of the present invention, provided that they are consistent with the use intended for the composition. Typical additives include corrosion inhibitors, rust inhibitors, viscosity index improvers, pour point depressants, extreme pressure additives, anti-foam agents, anti-stain additives, anti-foulants, and detergents. However, special attention should be paid to the desirability or undesirability of introducing ash-forming metals or phosphorus compounds, for reasons described below.

One advantage of the present compositions is that the amount of varnish in a natural gas-fueled engine is reduced, compared to the amount formed in other substantially metal-free compositions. The present compositions have also been found to be useful for reducing the amount of piston deposits in such engines, and for retaining the basicity and controlling the viscosity increase of oils in which they are used.

One further advantage of the compositions of the present invention is that they are substantially free from metals. One alternative expression of this property is to say that the materials can be prepared as substantially ashless compositions. A low ash or a substantially ashless composition is one which contains less than 1% sulfated ash, as determined by ASTMD-874. Accordingly, the present compositions are capable of serving as satisfactory lubricants, particularly for diesel fueled or natural gas fueled engines, even when prepared so as to contain less than 1% sulfated ash, preferably less than 0.5% or 0.4% sulfated ash, and more preferably less than 0.1% sulfated ash or even lower. In one preferred embodiment, no ash-forming metals are present, so the composition will be entirely ash-free (except for whatever incidental metal contamination may be unavoidable). In particular, it is preferred that the amount of sulfated ash of the composition be less than 0.01%. Of course, if the composition is supplied as a concentrate, these limits would be correspondingly increased. In practice this means that little or no metal-containing detergents are required or desired in the formulations.

Moreover, since the composition is capable of serving as a satisfactory lubricant at a very low phosphorus level, it is preferred that the composition be low in phosphorus, that is, contain less than 0.03% phosphorus, and more preferably less than 0.005% phosphorus (and correspondingly higher amounts in a concentrate). That is to say, normally the total amount of phosphorus present will be that amount which is contributed by the phosphorus which may be present in the anti-nitration agent. Since the amount of the anti-nitration agent in the composition is normally quite low, the amount of phosphorus contributed thereby will be correspondingly low. It is preferred that no additional phosphorus components be present beyond the phosphorus contained in the anti-nitration agent, although amounts which do not negate the usefulness of the present invention in the application at hand can be employed.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms other than carbon present in a chain or ring otherwise composed of carbon atoms.

EXAMPLES

Example 1

A composition is prepared by blending 6.1 weight % polyisobutylene (number average molecular weight about 2000) -substituted succinic acid/polyethyleneamine amide dispersants (including about 50 % diluent oil), 2.0 weight percent 2,6-di-t-butyl-4-methylphenol, 1.1 weight percent $C_9$ mono- and di-p-alkylated diphenylamines (including 16% diluent oil), 0.02 weight percent of propylene oxide-treated 2-methyl-pentanyl phosphorodithioic acid, subsequently reacted with phosphoric anhydride, the product being neutralized with t-alkyl primary amine (the anti-nitration agent), 0.55 weight percent borated polytetradecyloxirane, and 60 parts per million antifoam agent in kerosene, along with 0.28 weight percent additional diluent oil, in Exxon 600 Neutral oil.

The composition is used to lubricate a natural gas-fueled 2.3 L displacement Ford VD engine. After the engine is run for 120 hours it is disassembled. The average piston deposit is rated at 4.3 on a scale of 1–10, which indicates good performance, particularly for a lubricant formulated without metal-containing detergents.

Example 2

The composition of Example 1 is used to lubricate a diesel engine, American Petroleum Institute Caterpillar 1H2 test. After the test the engine shows no observable deposits in the top ring grooves.

Example 3

The composition of Example 1 is used in the American Petroleum Institute L-38 bearing corrosion test. After 40 hours of testing the bearing weight loss is 30.0 mg.

Examples 4–12

Compositions are prepared using the components and concentrations (active chemical basis) shown in Table I. (Identities of the chemicals used are shown in Table II.) Examples 4–11 are prepared in mineral oil. Example 11 represents a concentrate. Example 12 is prepared in a polyol-ester oil. In some cases small amounts of conventional additives (such as an anti-foam agent) are present, although not specifically reported.

TABLE I

| Ex | Antiox. #1, % | | Antiox. #2, % | | Antinitration agent, % | | Borated mat'l, % | | Dispersant, % | |
|---|---|---|---|---|---|---|---|---|---|---|
| 4 | A | 1 | D | 0.8 | G | 0.1 | K | 4 | N | 3 |
| 5 | B | 5 | E | 5 | G | 0.01 | K | 0.1 | N | 3 |
| 6 | C | 4 | — | 0 | G | 0.04 | K | 1 | P | 3 |
| 7 | A | 2 | F | 1 | G | 0.02 | L | 0.3 | N | 1 |
| 8 | A | 2 | D | 1 | H | 0.02 | M | 0.4 | Q | 3 |
| 9 | A | 2 | D | 1 | J | 0.02 | K | 0.2 | N | 10 |
| 10 | A | 2 | D | 1 | G | 0.02 | K | 1 | — | 0 |
| 11 | A | 27 | D | 13 | G | 0.3 | K | 5 | N | 40 |
| 12 | A | 2 | D | 1 | G | 0.02 | K | 0.3 | R | 3 |
| 13 | A | 27 | D | 13 | G | 0.04 | — | 0 | N | 3 |

Antioxidants

A 2,6-di-t-butyl-4-methylphenol

B 2,4,6-tri-t-butylphenol

C 4,4'-methylenebis(2,6-di-t-butylphenol)

D $C_9$ mono- and di-p-alkylated diphenylamines

E $C_{12}$ monoalkylaed diphenyl amine

F diphenyl amine

Antinitration Agents

G t-alkyl primary amine salt of reaction product of 2-methyl-propanol dithio acid with phosphoric anhydride.

H t-alkyl primary amine salt of reaction product of 2-ethyl-propanol dithio acid with phosphoric anhydride.

J cyclohexylamine salt of reaction product of 2-methyl-propanol dithio acid with phosphoric anhydride.

Borated Materials

K borated polytetradecyloxirane

L borated n-hexylcyclohexene oxide

M reaction product of trimethyl borate with 1,2-octadecanediol

Dispersants

N polyisobutylene-substituted succinic acid/tetraethylenepentamine amide of Ex. 1

P polyisobutylene-substituted succinic acid/N-(2-hydroxyethyl)ethylenediamine reaction product Q Mannich product of polybutenyl ($M_n$ 850) phenol, formaldehyde, and a polyethylene polyamine mixture containing about 3–7 nitrogen atoms per molecule and about 34.5% by weight nitrogen R reaction product of polyisobutylene-substituted succinic acid with pentaerythritol Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A method for lubricating a natural gas-fueled internal combustion engine, comprising supplying to the engine a composition comprising:

(a) an oil of lubricating viscosity;

(b) at least about 1.8% by weight of an antioxidant; and (c) a hydrocarbylamine phosphate salt anti-nitration agent, wherein the composition is substantially free from metals, and wherein the amount of the antioxidant and the amount of the anti-nitration agent are sufficient to reduce the amount of varnish formation in a natural gas-fueled internal-combustion engine.

2. The method of claim 1 wherein the amount of the antioxidant is at least about 1.8 percent by weight and the amount of the anti-nitration agent is at least about 0.01 percent by weight.

3. The method of claim 1 wherein the oil of lubricating viscosity is mineral oil.

4. The method of claim 1 wherein the antioxidant is at least one hindered phenol or at least one aromatic amine or a mixture thereof.

5. The method of claim 4 wherein the antioxidant is a mixture of di-t-butyl-4-methylphenol and alkylated diphenylamine.

6. The method of claim 1 wherein the composition further comprises (d) at least about 0.1% by weight of a borated product of an epoxide or the reactive equivalent of an epoxide.

7. The method of claim 6 wherein the epoxide or reactive equivalent thereof is an epoxide of the formula

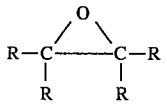

or a diol of the formula

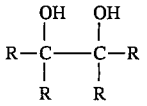

wherein each R is independently hydrogen or a hydrocarbyl group containing about 8 to about 30 carbon atoms, at least one of which is hydrocarbyl.

8. The method of claim 1 wherein the composition further comprises a dispersant.

9. The method of claim 8 wherein the dispersant is a succinimide dispersant.

10. The method of claim 8 wherein the amount of the dispersant is about 1 to about 10% by weight of the composition.

11. The method of claim 1 wherein the sulfated ash of the composition is less than about 0.01%.

12. The method of claim 1 wherein the composition contains less than about 0.03% phosphorus.

* * * * *